US008713877B2

(12) United States Patent
Underwood et al.

(10) Patent No.: US 8,713,877 B2
(45) Date of Patent: May 6, 2014

(54) METAL EDGING FOR CONCRETE SLABS

(75) Inventors: Daniel Charles Underwood, Morningside (AU); David John Thierens, Albany Creek (AU); Ryan Rogers, Belmont (AU)

(73) Assignee: Underwood Companies Holdings Pty Ltd, Queensland (AU)

( * ) Notice: Subject to any disclaimer, the term of this patent is extended or adjusted under 35 U.S.C. 154(b) by 0 days.

(21) Appl. No.: 13/284,382

(22) Filed: Oct. 28, 2011

(65) Prior Publication Data

US 2012/0102862 A1 May 3, 2012

(30) Foreign Application Priority Data

Oct. 28, 2010 (AU) ..... 2010236065
Jun. 30, 2011 (AU) ..... 2011902575

(51) Int. Cl.

| | |
|---|---|
| ***E04F 15/14*** | (2006.01) |
| ***E01C 11/08*** | (2006.01) |
| ***E01C 11/12*** | (2006.01) |
| *E04B 5/32* | (2006.01) |

(52) U.S. Cl.

CPC ..... *E01C 11/08* (2013.01); *E01C 11/126* (2013.01); *E04B 2005/322* (2013.01); *E04B 2005/324* (2013.01)

USPC ..... 52/396.02; 52/396.05

(58) Field of Classification Search

CPC . E01C 11/08; E01C 11/126; E04B 2005/322; E04B 2005/324; E04B 1/6804

USPC ..... 52/396.02, 396.04, 396.05, 393, 395, 52/586.1, 582.1; 404/87, 88, 47

See application file for complete search history.

(56) References Cited

U.S. PATENT DOCUMENTS

| | | | | |
|---|---|---|---|---|
| 2,358,328 | A * | 9/1944 | Heltzel | 404/59 |
| 4,111,584 | A * | 9/1978 | Fyfe | 404/69 |
| 4,804,292 | A * | 2/1989 | DeLuca | 404/69 |
| 6,354,053 | B1 * | 3/2002 | Kerrels | 52/396.04 |
| 6,775,952 | B2 * | 8/2004 | Boxall et al. | 52/396.05 |
| 8,302,359 | B2 * | 11/2012 | Boxall et al. | 52/396.02 |
| 2002/0078652 | A1 * | 6/2002 | Hawkes | 52/578 |
| 2003/0033778 | A1 * | 2/2003 | Boxall et al. | 52/396.02 |
| 2006/0075706 | A1 * | 4/2006 | Boxall et al. | 52/414 |
| 2009/0007512 | A1 * | 1/2009 | Kerrels | 52/396.02 |
| 2009/0158682 | A1 * | 6/2009 | Arnold | 52/364 |
| 2012/0117892 | A1 * | 5/2012 | Smith | 52/126.1 |

FOREIGN PATENT DOCUMENTS

| | | | |
|---|---|---|---|
| DE | 3424362 | A1 * | 1/1986 |
| EP | 1389648 | A1 * | 2/2004 |
| WO | WO 9955968 | A1 * | 11/1999 |

* cited by examiner

*Primary Examiner* — Brent W Herring
(74) *Attorney, Agent, or Firm* — Young & Thompson

(57) ABSTRACT

Edging strips for concrete floors employ parallel strips as lost formwork secured to removable timber formwork using a nailing bracket that has a horizontal plate section 32 and a vertical plate section 35, the horizontal plate section slides underneath one of the strips as the strips separate due to concrete contraction and supports a filler by bridging under the filler, the horizontal plate section comprises an elongate section of the horizontal plate section having lobes 33 and 34 at each end. These lobes are welded to the underside of one of the strips 11 or 12 with the other strip located on top of the elongate section. The vertical plate is a fixing plate 35 with predrilled holes for nailing to the timber form, the elongate section having tapered corners opposite each lobe and the vertical plate extending in a plane located between the lobes.

10 Claims, 7 Drawing Sheets

METAL EDGING FOR CONCRETE SLABS

TECHNICAL FIELD

THIS INVENTION relates to improvements in and in relation to edging and metal edging for concrete slabs and in particular but not limited to metal edging of the type employing an upper flange in a concrete joint to protect the upper corner edge of a slab to which the edging is fixed and to an improved nailing bracket for this type of edging.

BACKGROUND

Applicant has for the first time recognized problems that were not previously recognized in relation to concrete joints employing edging of the type using prefabricated parallel metal strips or bars to form the joint. The strips or bars are held together for transport and installation purposes using some kind of frangible connection so that when in-situ the strips or bars, as the case may be, can separate as the concrete contracts. In this way the strips remains in intimate protective engagement with the concrete so that each strip serves to protect the adjacent edge of the concrete at the joint.

Applicant's specification is directed to a number of improvements and these are set out below both independently and in combination. Applicant reserves the right to divide the application and/or claim the improvements in combination subject to the outcome of any official search and examination.

In the present specification a reference to "metal" is non-limiting as other material may be used but generally these materials will be effective in protecting the edge of the concrete and could include particular plastics or other materials that might be sufficiently robust.

Outline

In one broad form of the invention there is provided an improvement in metal edging for concrete slabs, the edging comprising first and second edging strips running parallel to one another, the first edging strip having a longitudinally extending web and an upper flange, the second edging strip having a longitudinally extending web and an upper flange mating the flange of the first edging strip, the strips being set in back to back relationship with upper flanges of the strips being in alignment and extending in opposite transverse directions, a fixing plates extending from one of said strips, the fixing plate being adapted to secure the edging to formwork located below the edging, the fixing plate having a horizontal slide plate overlapping and slidable across a lower edge of one of said strips and the fixing plate having a vertical plate adapted to fix the vertical plate to the formwork.

Typically, plural spaced fixing plates are employed and each fixing plate comprises a nailing bracket having plates at 90 degrees, the vertical plate having spaced holes to receive fasteners, at least one of said strips having a lower horizontal flange with an edge and the flange being adapted to locate the edging on top of formwork of rectangular section with the flange being on top of the formwork and the vertical plate forming a right angle with the flange, with the vertical plate being securable to a vertical side of the formwork in offset relation from the edge of the flange.

In a preferred form the vertical plate has spaced holes to receive fasteners, the fixing plate comprising an elongate horizontal section of the plate having projecting lobes at each end, secured to an underside of one of the strips with the other strip located on top of the elongate horizontal section, the elongate section having tapered corners opposite each lobe and the vertical plate extending in a plane located between the lobes.

In another aspect there is provided an improvement in metal edging for concrete slabs, the edging comprising a first edging strip having a longitudinally extending web and preferably an upper flange and a second edging strip having a longitudinally extending web and preferably also an upper flange mating the flange of the other strip, the strips being set in back to back relationship with upper edges of the strips being in alignment and extending in opposite transverse directions, spaced vertical fixing means extending from the strips and being rigid with one of said strips, the fixing means being adapted to secure the edging to formwork located below the edging, the form being secured using spaced nailing brackets having plates at 90 degrees, the plates having spaced holes to receive fasteners.

In another aspect there is provided an improvement in metal edging in a form work assembly comprising metal edging as described in the preceding paragraph, the edging having a lower horizontal flange adapted to locate the edging on top of a form with the fixing means preferably comprising a plate secured to the side of the form in offset relation. In this case the lower flange and the plate are typically set at 90 degrees and a nail or screw or other fitting is driven or screwed through the fixing plates into the form. The form may be timber and below the edging in use dowel sleeves may be secured to the timber form. After one slab is poured the timber form is stripped away leaving the metal edging in place and then another slap is poured. When the slabs contract the strips separate with the slabs. It is preferable to have each strip equipped with projecting bolts or other suitable transverse projecting means that project into the slabs to aid retention of the strips and prevent separation of the strips from the concrete.

Typically, the edging strips are held together by frangible fasteners. Typically the frangible fasteners comprise spaced apart rivets with plastics washers so the rivets pass through the edging strips and are expanded within the washers so that the rivets shear off when the concrete contacts and the strips separate.

In another improvement, there is provided edging for concrete at a joint, the edging comprising back-to-back edging strips adapted as lost formwork in concrete and being adapted to separate upon contraction of the concrete to form a gap between the strips, each edging strip having an upper edge, a bridging member extending across the strips and being secured to at least one of the edging strips so that upon separation of the edging strips in-situ, the bridging member extends at least part way across the gap below the upper edge. Typically, the bridging member slides underneath the other edging strip. Preferably the bridging member is plate welded or otherwise secured to an underside of one of the strips so that it projects under the other strip.

In one preferred embodiment the bridging member is a trapezium shaped plate. Preferably the bridging member is one of a plurality of spaced bridging members located along the length of the strips.

In a preferred aspect, a gap between strips in a concrete metal edging comprising separable strips is fillable by a filling strip insertable in the gap after the strips have separated, the gap so formed having a bottom and a top, the top being adjacent an upper edge of the edging, the edging having a filling strip support located in the gap at so that the filling strip is located substantially contiguous with the upper edge of the edging when located in the gap and supported by the support. Typically the support is a bridging member as described above. The filling strip may be a mastic paste or a preformed strip in metal or hard plastics or any suitable filler may be employed.

BRIEF DESCRIPTION OF THE DRAWINGS

In order that the present improvements may be more readily understood and put into practical effect reference will now be made to the accompanying drawings which illustrate preferred embodiments of the invention and wherein:—

METHOD OF PERFORMANCE

Figure 1:
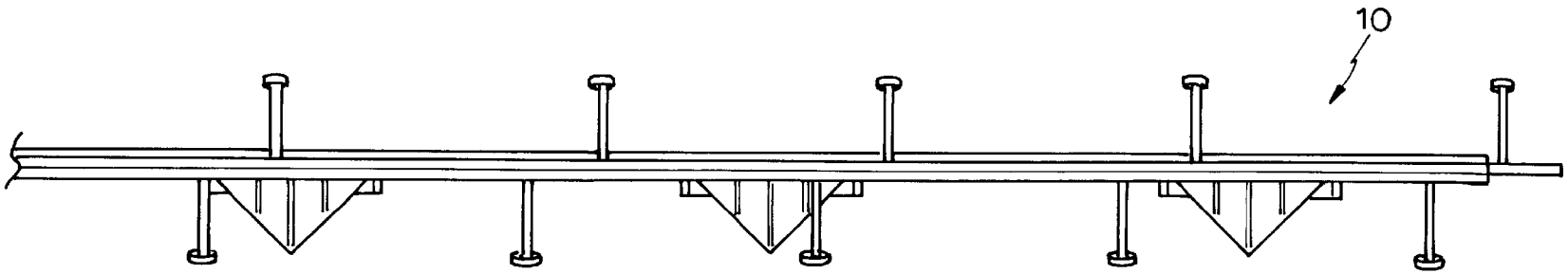
FIG. 1 is a plan view of a formwork assembly according to the present invention.
Figure 2:
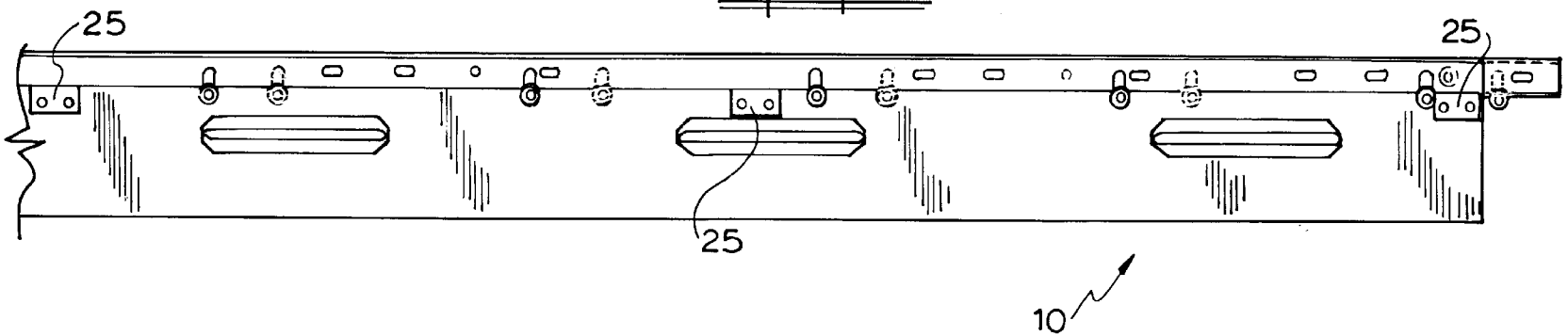
FIG. 2 is a side view of the formwork assembly of FIG. 1.
Figure 3:
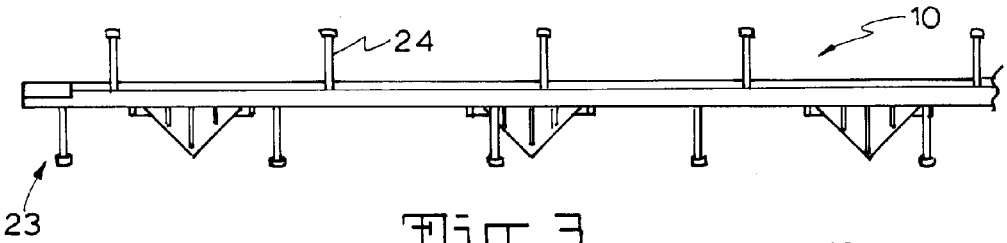
FIGS. 3 and 4 are opposite ends of the assembly illustrated in FIGS. 1 and 2.
Figure 4:
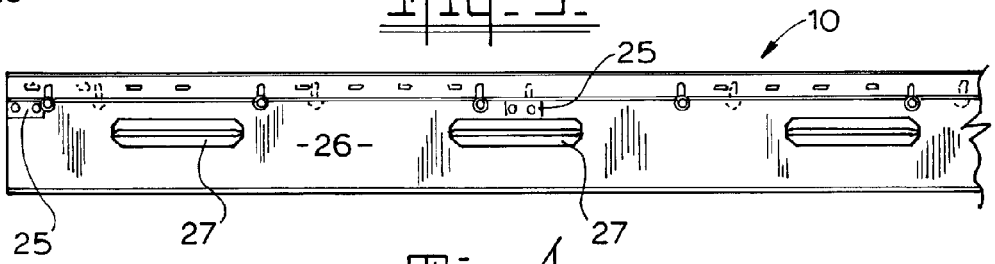
Figure 5:
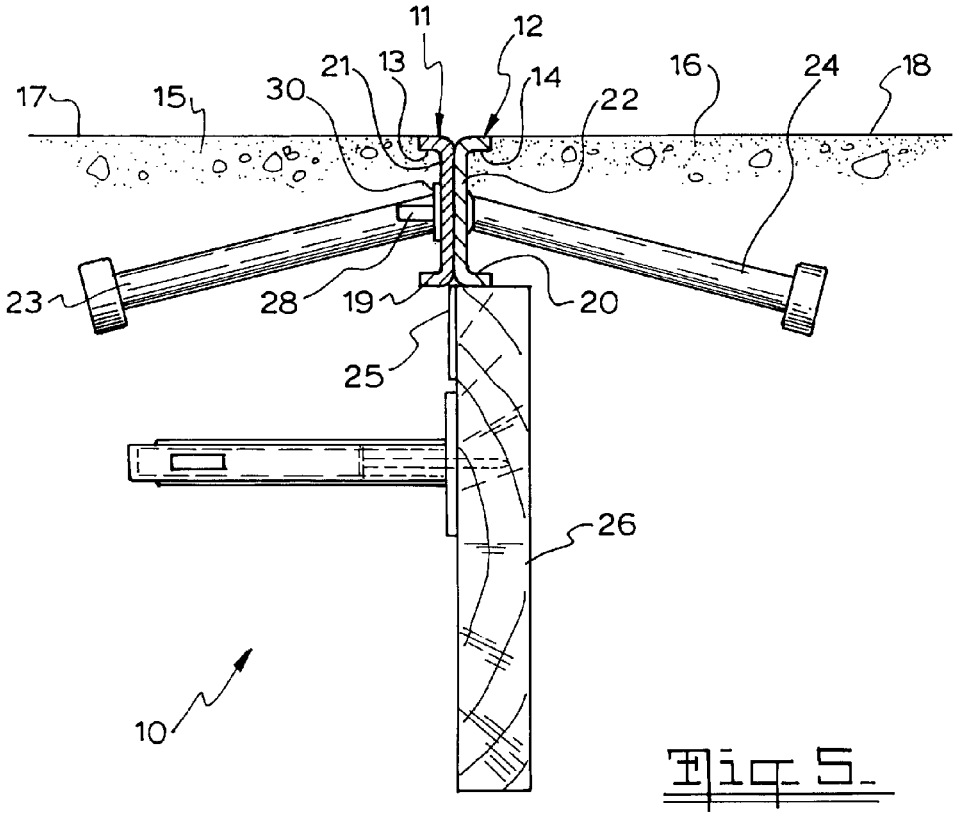
FIG. 5 is an end view of the formwork assembly of FIGS. 1 to 4.
Figure 6:
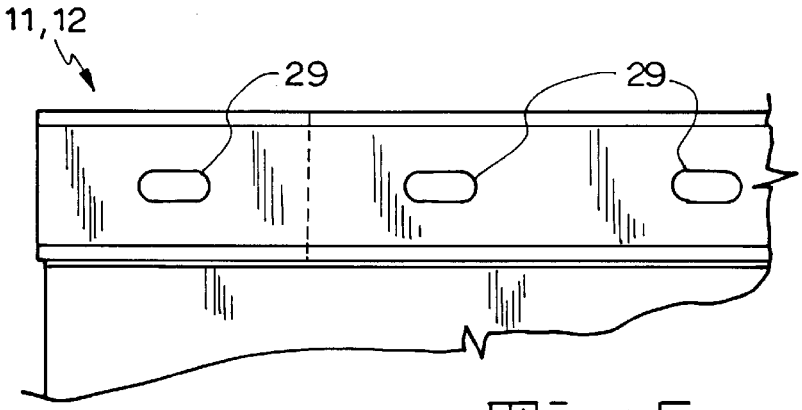
FIGS. 6 to 9 illustrate part of the formwork assembly of FIGS. 1 to 5 illustrating in particular a shear rivet arrangement which holds the edging strips together while the concrete is being poured.
Figure 7:
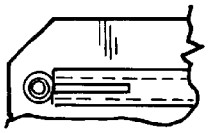

Referring to the drawings and initially to FIGS. 1 to 5 there is illustrated a formwork assembly 10 comprising edging strips 11 and 12 which have upper flanges 13 and 14 positioned to protect the edges of concrete slabs 15 and 16 respectively, the upper surface of the concrete being shown in FIGS. 5 at 17 and 18.

The edging strips 11 and 12 have lower flanges 19 and 20 and respective webs 21 and 22 which are in abutment so the strips are in back to back relation with the flanges 11, 12, 19 and 20 extending transversely in opposite directions.

Spaced headed rods 23 and 24 on opposite sides serve to retain the edging strips 11 and 12 in place and vertical fixing plates 25 are welded at spaced intervals to the strip 11 with each plate 25 have a pair of spaced nail holes so that the edging may be nailed to a timber form being plank 26. Dowel sleeves 27 are also nailed to the timber form.

Strips 11 and 12 and the headed rods 23 and 24 and the dowel sleeves 27 are lost in the concrete slab 15 and the timber plank 26 is stripped from the slab 15 before the slab 16 is poured. After the plank 26 is stripped dowels are inserted into the sleeves 27 before the slab 16 is poured.

It will be appreciated that in the region of contact with the form of the flange 20 and the plates 25 there is a right angle between the flange 20 and the plate 25 and this serves to easily locate and secure the strip in proper position relative to the plank 26. Of course the plank 26 ideally is selected to be straight so that the proper depth and positioning of the edging strip can be achieved. Since the first slab to be poured is the slab 15 and the flange 25 is on the same side of the timber plank 26 the tendency of either of the edging strips 11 and 12 to roll to the right in terms of FIG. 5 will be reduced by this arrangement of fixing of the strip to the plank 26 in offset.

Figure 8:
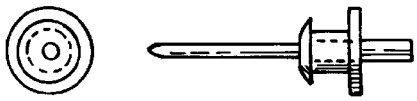
Figure 9:
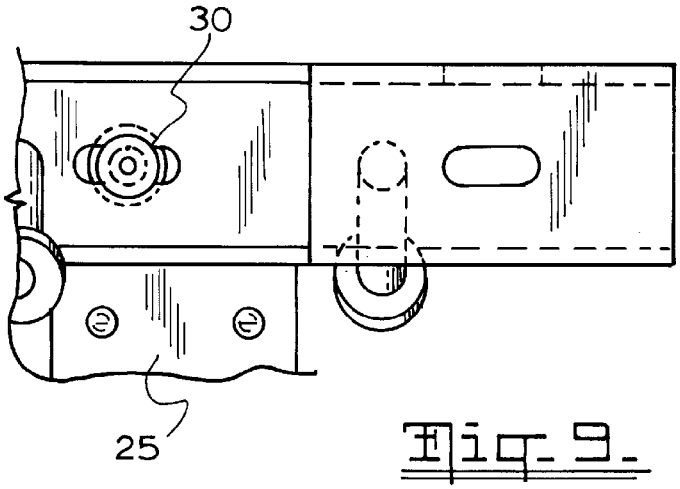

Once the slab 16 has been poured and the concrete expands and contracts, rivets 28 are designed to shear so that the plates 11 and 12 may separate. Thus the strips 11 and 12 have spaced holes 29 for the purpose of taking the rivets illustrated in FIG. 8 and the rivet is retained in place by being passed through a nylon washer 30 and the rivet is selected so that it shears when the concrete contracts. The strips 11 and 12 separate and a gap is formed between then.

Now one improvement set out above is the implementation of a platform for a filler to go in this gap. While a single long platform could be provided it is preferable to locate short horizontal plates at spaced interval along one of the strips. In the preferred embodiment these are centred on the headed rods 23 and 24 so there is one for each rod.

Figure 10A:
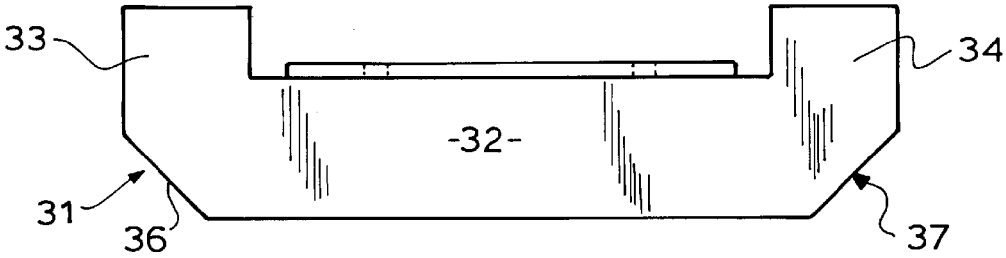
FIG. 10A-10C are respective top, front and side views of a combined fixing plate and bridging member which may be welded to one of the strips to provide the dual function of securing to a timber form and also supporting a gap filler.
Figure 10B:
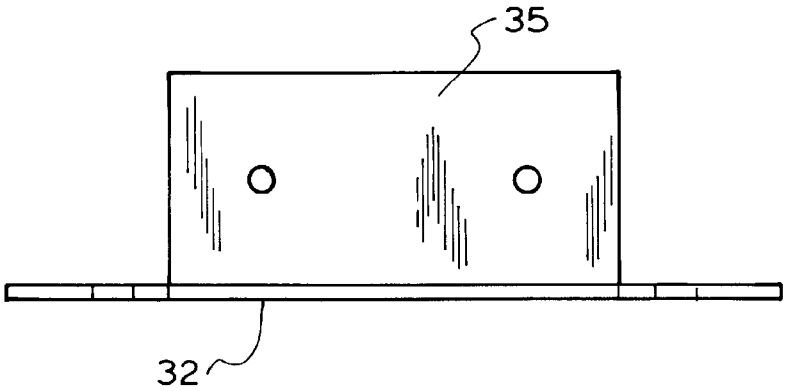
Figure 10C:
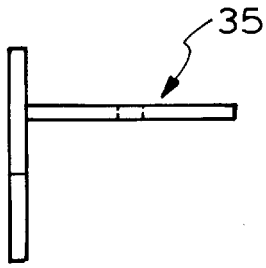

FIGS. 10A-10C show a typical bridging member 31 comprising a steel plate with a platform 32 comprising an elongate section of the plate having lobes 33 and 34 at each end. These lobes are welded to the underside of one of the strips 11 or 12 with the other strip located on top of the platform. It is convenient to form a fixing plate 35 which functions the same as the fixing plate 25 of the earlier example. It will be appreciated that the fixing plate and the bridging member need not be made in a single unit but this works better for ease of manufacture and assembly.

The platform 32 has tapered corners 36 and 37 to aid release from the concrete.

Figure 11:
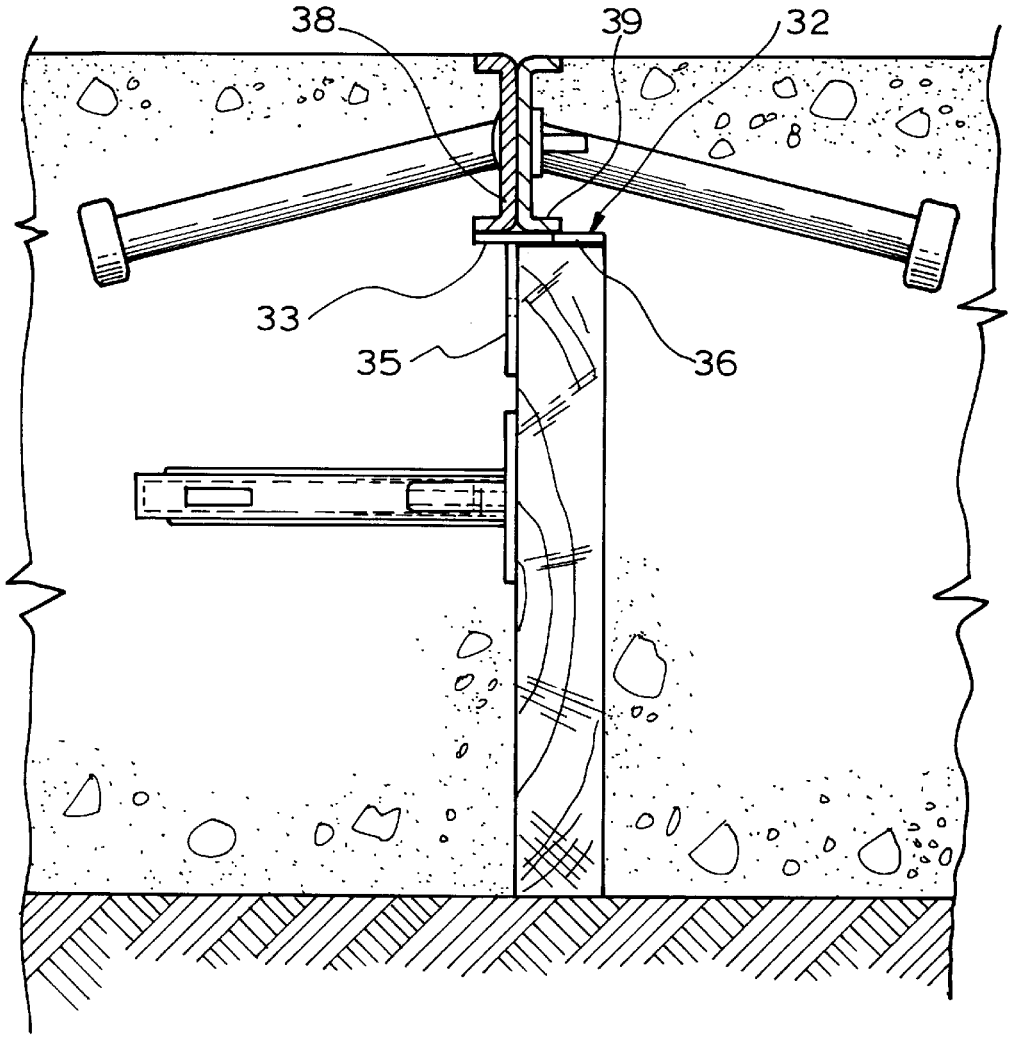
FIG. 11 illustrates the combined fixing plate and bridging member in section.
Figure 12:
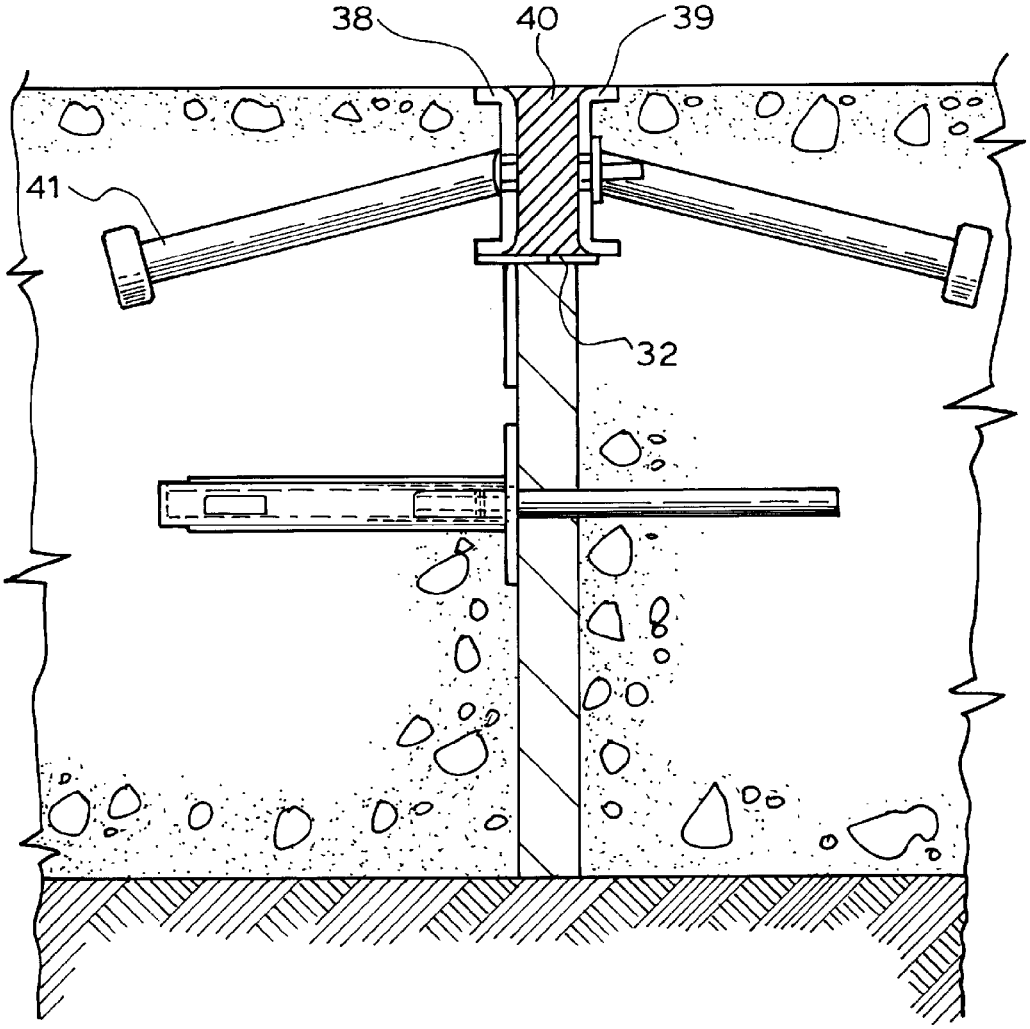
FIG. 12 is a view similar to FIG. 11 but showing the strips separated and filler in place in the gap between the strips and supported on the bridging member.

FIG. 11 shows a combined fixing plate and bridging member 31 in place. The lobe 33 (and lobe 34) is welded to the strip 38 and the strip 39 will slide on the platform 32 as the strips separate. This is shown in FIG. 12; only the left side slab has been poured in FIG. 11. The timber form is stripped away and the right side slab is poured and after contraction the strips 38 and 39 separate and a filler 40 shown cross hatched is inserted to fill the gap with the filler seated on top of the platform 32. As mentioned above the combined fixing plates and bridging members are secured on at each rod.

Figure 13:
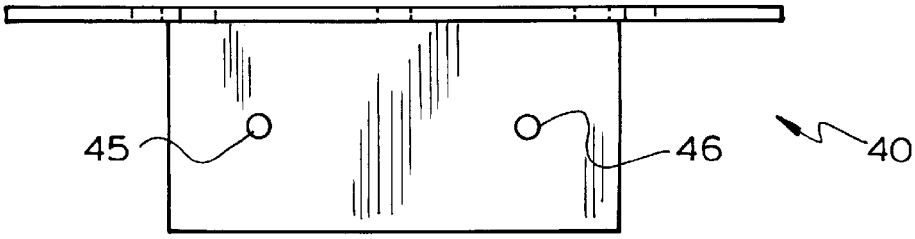
FIG. 13 is a top view of a further embodiment showing an improved nailing bracket according to another form of the invention.
Figure 14:
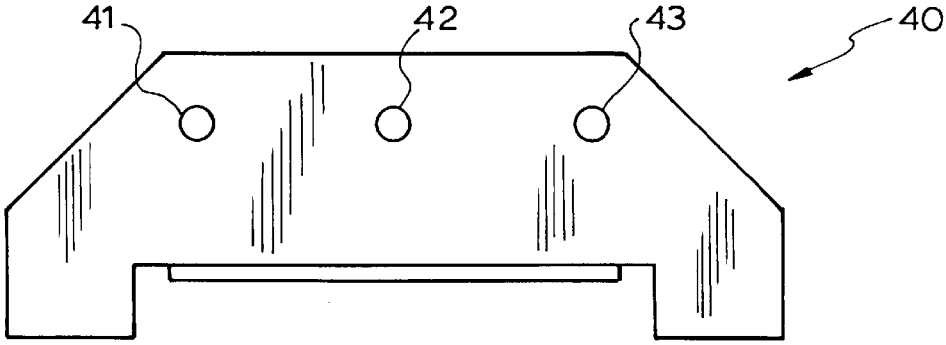
FIG. 14 is a front view of the embodiment of FIG. 13.
Figure 15:
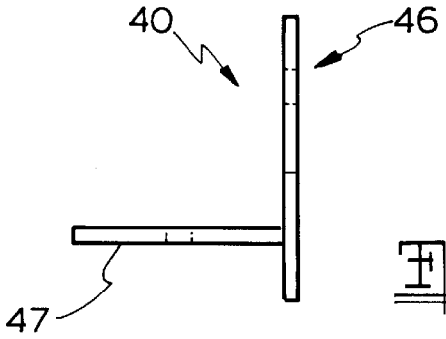
FIG. 15 is a side view of the embodiment of FIGS. 13 and 14

FIGS. 13 to 15 are similar to FIGS. 10A-10C and the bracket 40 of these Figures is used in the same way save for the extra three nail holes 41, 42 and 43 in addition to holes 45 and 46. As can be seen in the side view of FIG. 15 the holes 41-45 are set in plates 46 and 47 set at right angles and the timber form may therefore be nailed through any or all of these holes. This means there are options for placing nails and this can in certain circumstances make it easier to strip the timber form than in the case of the FIGS. 10A-10C embodiment.

Whilst the above has been given by way of illustrative example many variations and modifications will be apparent to those skilled in the art without departing from the broad ambit and scope of the invention as set out in the appended claims.

The invention claimed is:

1. An improvement in metal edging for concrete slabs, the edging comprising first and second edging strips running parallel to one another, the first edging strip having a longitudinally extending web and an upper flange, the second edging strip having a longitudinally extending web and an upper flange mating the flange of the first edging strip, the strips being set in back to back relationship with upper flanges of the strips being in alignment and extending in opposite transverse directions, a fixing plate extending from one of said strips, the fixing plate being adapted to secure the edging to formwork located below the edging, the fixing plate having a horizontal slide plate overlapping and slidable across a lower edge of one of said strips and the fixing plate having a vertical plate adapted to fix the fixing plate to the formwork, wherein plural spaced fixing plates are employed and each fixing plate comprises a nailing bracket having plates at 90 degrees, the vertical plate having spaced holes to receive fasteners, the fixing plate comprising an elongate horizontal section of the fixing plate having projecting lobes at each end, secured to an underside of one of the strips with the other strip located on top of the elongate horizontal section, the elongate horizontal section having tapered corners opposite each lobe and the vertical plate extending in a plane located between the lobes.

2. An improvement in metal edging according to claim 1, at least one of said strips having a lower horizontal flange with an edge and the flange being adapted to locate the edging on top of formwork of rectangular section with the flange being on top of the formwork and the vertical plate forming a right angle with the flange, with the vertical plate being securable to a vertical side of the formwork in offset relation from the edge of the flange.

3. An improvement in metal edging according to claim 1, the edging strips being adapted as lost formwork in concrete and being adapted to separate upon contraction of the concrete to form a gap between the strips, each edging strip having an upper edge, the fixing plate comprising a bridging member extending across the strips and being secured to at least one of the edging strips so that upon separation of the edging strips in-situ, the bridging member extends at least part way across the gap the bridging member slides underneath the other edging strip.

4. An improvement in metal edging according to claim 1, wherein the fixing plate is a trapezium shaped plate with a right angle fold.

5. An improvement in metal edging according to claim 1, wherein in use a gap is formed between the strips comprising separable strips, the gap being fillable by a filling strip insertable in the gap after the strips have separated, the gap so formed having a bottom and a top, the top being adjacent an upper edge of the edging, the horizontal plate providing a filling strip support located in the gap at so that the filling strip is located substantially contiguous with the upper edge of the edging when located in the gap and supported by the horizontal plate.

6. An improvement in metal edging according to claim 1, wherein a filling strip is located in a gap between the two strips, the filling strip being supported by the horizontal plate.

7. An improvement in metal edging for concrete slabs, the edging comprising first and second edging strips running parallel to one another, the first edging strip having a longitudinally extending web and an upper flange, the second edging strip having a longitudinally extending web and an upper flange mating the flange of the first edging strip, the strips being set in back to back relationship with upper flanges of the strips being in alignment and extending in opposite transverse directions, a fixing plate extending from one of said strips, the fixing plate being adapted to secure the edging to formwork located below the edging, the fixing plate having a horizontal slide plate overlapping and slidable across a lower edge of one of said strips and the fixing plate having a vertical plate adapted to fix the fixing plate to the formwork, wherein a filling strip is located in a gap between the two strips, the filling strip being supported by the horizontal plate, the fixing plate comprising an elongate horizontal section of the fixing plate having projecting lobes at each end, secured to an underside of one of the strips with the other strip located on top of the elongate horizontal section, the elongate horizontal section having tapered corners opposite each lobe and the vertical plate extending in a plane located between the lobes.

8. An improvement in metal edging according to claim 7, wherein plural spaced fixing plates are employed and each fixing plate comprises a nailing bracket having plates at 90 degrees, the vertical plate having spaced holes to receive fasteners.

9. An improvement in metal edging according to claim 7, at least one of said strips having a lower horizontal flange with an edge and the flange being adapted to locate the edging on top of formwork of rectangular section with the flange being on top of the formwork and the vertical plate forming a right angle with the flange, with the vertical plate being securable to a vertical side of the formwork in offset relation from the edge of the flange.

10. Metal edging securable to concrete slab formwork, the edging comprising:

a first edging strip with a longitudinally extending web, an upper flange, and a lower flange;

a second edging strip with a longitudinally extending web and an upper flange mating the upper flange of the first edging strip, the second edging strip running parallel to the first edging strip in a back to back relationship with the upper flanges of the first and second edging strips being in alignment and extending in opposite transverse directions; and a fixing plate extending downwardly from one of the first and second edging strips, the fixing plate comprising i) a horizontal slide plate overlapping and slidable across a lower edge of the one of said first and second edging strips, and ii) a vertical plate joined to the horizontal slide plate, the vertical plate having holes to receive fasteners to fix the fixing plate to the formwork with the lower flange of the first edging strip located above the formwork, wherein, the fixing plate is a trapezium shaped plate with a right angle fold, and the vertical plate is joined to the horizontal slide plate at the right angle fold.

* * * * *